US005827157A

United States Patent [19]

Lee

[11] Patent Number: 5,827,157

[45] Date of Patent: Oct. 27, 1998

[54] ARM MUSCLE EXERCISER

[76] Inventor: Te-Yuan Lee, No. 35, Guo-ling, Chung-Li City, Tao-Yuan Hsien, Taiwan

[21] Appl. No.: 944,098

[22] Filed: Sep. 30, 1997

[51] Int. Cl.[6] ..... A63B 21/075

[52] U.S. Cl. ..... 482/93

[58] Field of Search ..... 482/93, 94, 98, 482/97, 106–109; 430/260, 263

[56] References Cited

U.S. PATENT DOCUMENTS

| | | | |
|---|---|---|---|
| 2,470,815 | 5/1949 | Harvey | 482/106 |
| 3,653,697 | 4/1972 | Ernst | 403/263 |
| 5,496,240 | 3/1996 | Damm | 482/93 |

*Primary Examiner*—John Mulcahy
*Attorney, Agent, or Firm*—Rosenberg, Klein & Bilker

[57] ABSTRACT

An arm muscle exerciser includes a main stand, a base plate, two handles and several weight discs; the upper part of the main stand is a smaller diameter section with a smaller outer diameter; the base plate is joined to the bottom of the main stand; each end of the two handles has an end pivotally attached to a respective one of a pair of parallel pivot axles on opposite sides of the upper part of the main stand such that they pivot symmetrically in a plane; in the weight disc is an accommodating hole; at one side of the accommodating hole is an opening; the smaller diameter section of the main stand may be inserted into the accommodating hole through the opening, and slide down along the outer diameter of the main stand to fall onto the base plate, so the base plate will support an appropriate number of weight discs. This construction achieves such functions as to train arm muscles, to enable simplified configuration, easy assembling process, lower production costs, convenient operational procedures, adjustable weights, and better training efficiency, etc.

3 Claims, 5 Drawing Sheets

ARM MUSCLE EXERCISER

BACKGROUND OF THE INVENTION

The subject invention relates to a type of arm muscle exerciser, particularly to one that enables lower production costs, convenient operation, and better training efficiency.

Social development has brought along the civilization of modernized living conditions; but relatively, the opportunities for people's activities and exercises are greatly reduced, the result is more frequent illness and pains to our body; and consequently, we have seen the development of various types and models of physical fitness equipment and training machines.

There are various training machines with different functions available on the market, including, of course, arm muscle exercisers which are either of sophisticated construction, expensive production costs, or inconvenient in actual application or unsatisfactory in training efficiency.

SUMMARY OF THE INVENTION

The primary purpose of the subject invention is to present a type of arm muscle exerciser, comprising a main stand, a base plate, two handles and one or more weight discs; the upper part of said main stand is a smaller diameter section; said base plate is joined to the bottom end of said main stand; each end of said two handles is joined by a joining component to each of the two joints at two sides of the upper section of said main stand; in the center of said weight disc is an accommodating hole; one side of the accommodating hole is an opening; the smaller diameter section of the main stand may be inserted into the accommodating hole through the opening, and slide down along the outer diameter of the main stand, to fall down onto the base plate, so the base plate will support the weight discs; the user may use his two hands to hold the two handles, and exert force to lift the main stand by means of the two joints that are connected to the inside ends of the two handles; by repeated operation of lifting and lowering the main stand, with the assistance of an appropriate number of weight discs positioned on the base plate, the purpose of training the arm muscle may be achieved; with its simplified construction, easy assembling process, lower production costs, convenient operation, unique operational method, and with the coordination of proper control of the number of weight discs, better training efficiency may be accomplished.

To enable better understanding of the characteristics and technical contents of the subject invention, please refer to the following detailed description with drawings; however, the attached drawings are only for the purposes of reference and description, which shall not be based to restrict or limit the subject invention:

BRIEF DESCRIPTION OF NUMERALS

| | |
|---|---|
| 10 main stand | |
| 11 smaller diameter section | 12 joint |
| 13 joint hole | 14 screw hole |
| 20 base plate | |
| 21 inserting groove | 22 through hole |
| 23 screw | |
| 30 handle | |
| 31 joint hole | 32 handle grip |
| 33 foam wrapping | 34 screw |
| 35 nut | |
| 40 weight disc | |
| 41 accommodating hole | 42 opening |

DETAILED DESCRIPTION OF PREFERRED EMBODIMENT

Figure 1:
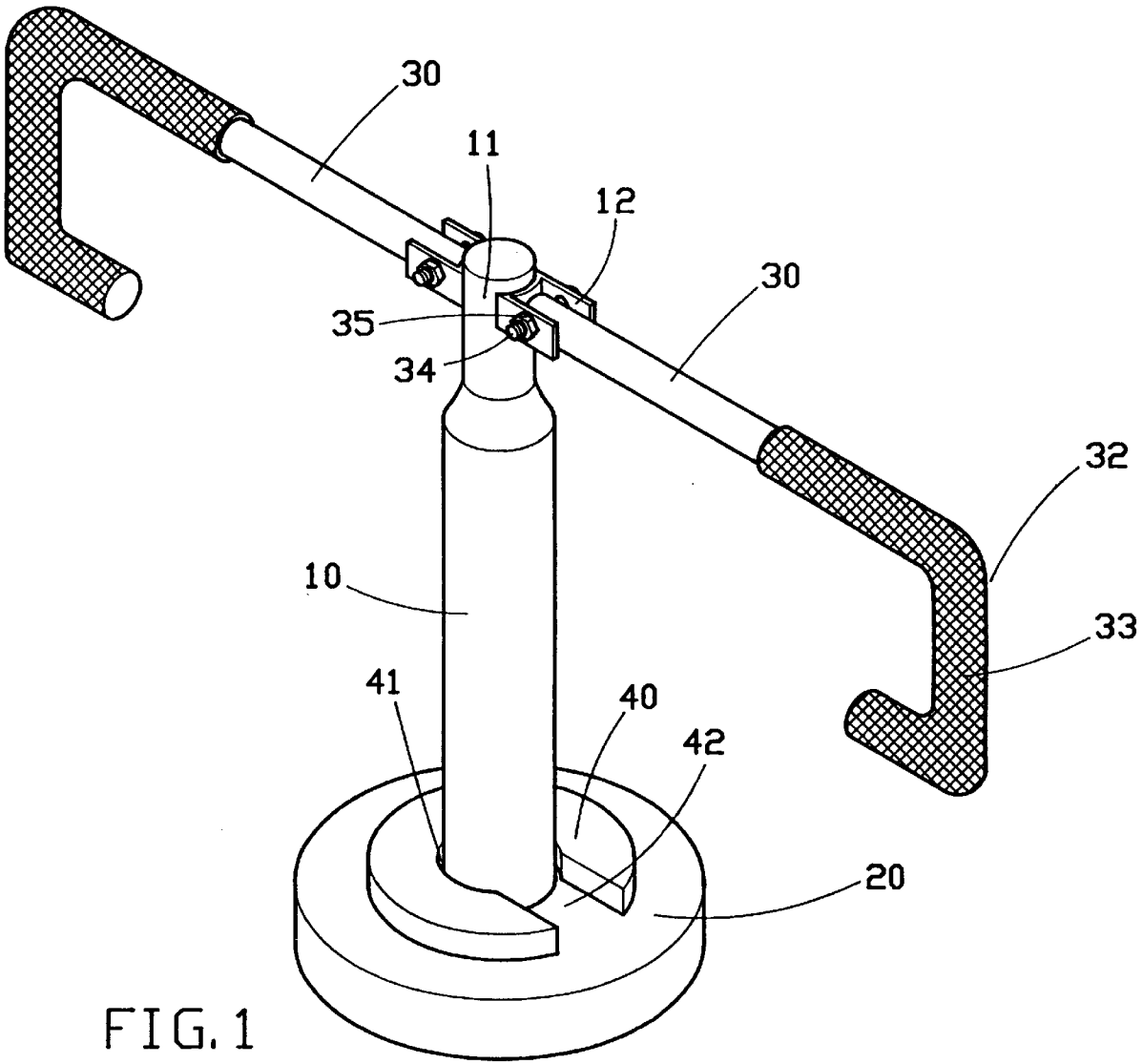
FIG. 1 is a perspective assembled view of the subject invention.
Figure 2:
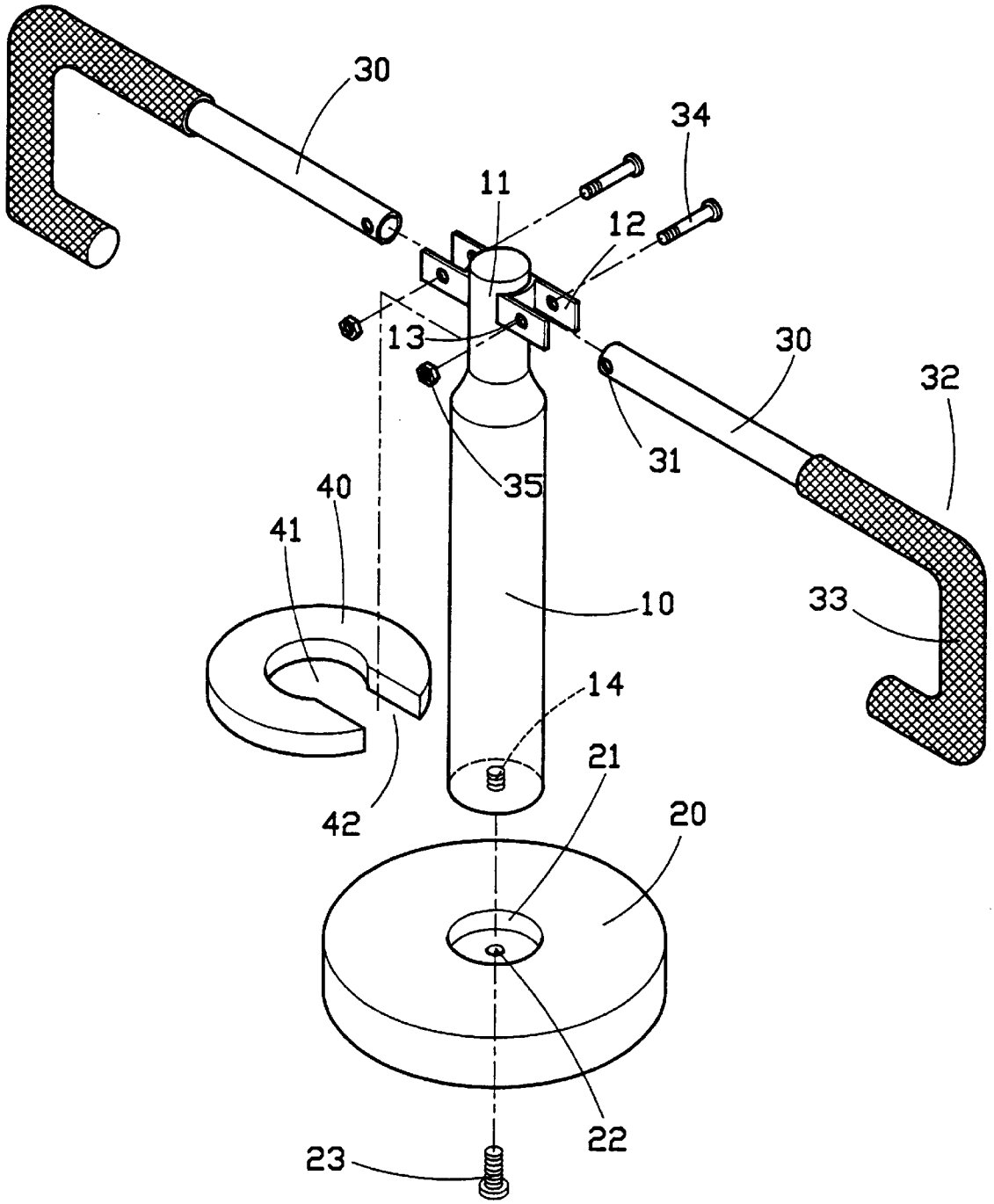
FIG. 2 is an exploded view of the subject invention.
Figure 3:
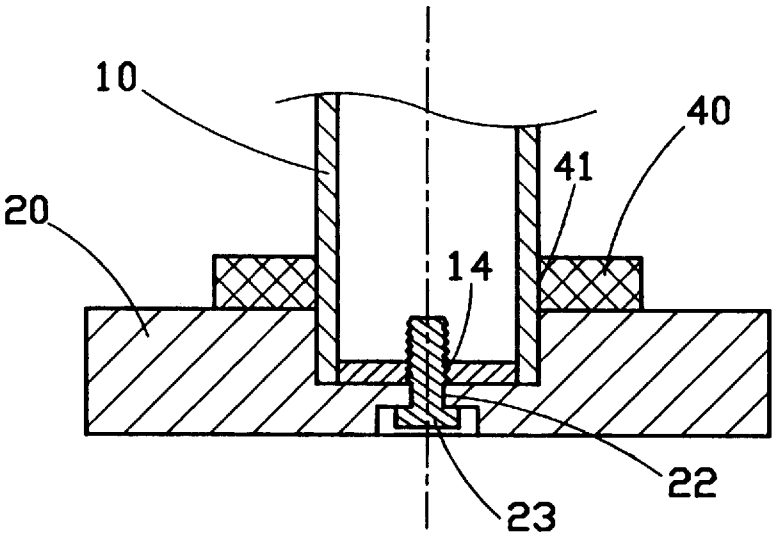
FIG. 3 is a plain sectional view of the subject invention.

Please refer to FIGS. 1, 2 and 3 which are respectively a perspective assembled view, an exploded view and a plain sectional view of the subject invention. The subject invention relates to the presentation of a type of arm muscle exerciser comprising a main stand 10, a base plate 20, a handle 30 and one or more weight discs 40; wherein, the main stand is a hollow tube with sections of different diameters, with its top and bottom ends properly sealed; the upper portion of said main stand 10 is a smaller diameter section 11 with a smaller diameter; each of two sides of the smaller diameter section 11 on the upper part of the main stand 10 is welded with a U-shaped joint 12; the two sides of said U joint 12 are penetrated with a joint hole 13; on the bottom of the main stand is a screw hole 14.

The base plate 20 is a round disc with a diameter larger than that of the main stand 10; on its top side is an inserting groove 21 that corresponds with the bottom end of the main stand 10; inside said inserting groove 21 is a penetrating hole 22 that corresponds with the screw hole 14 on the bottom end of the main stand 10. The inserting groove 21 of said base plate 20 is inserted by the bottom end of the main stand 10, with a screw 23 penetrating the through hole and into the screw hole 14 on the bottom end of the main stand 10, to fasten the base plate 20 to the bottom end of the main stand 10.

The handle is made of a bent hollow tube; one end of which is a joint hole 31, the other end is shaped as a handle grip 32; on said handle grip 32 is a polyurethane (PU) foam wrapping 33. Each of the two ends of said two handles with the joint hole 31 is fitted inside each of the two joints 12 on the main stand 10, so positioned that the joint holes 31 of the two handles 30 match the joint holes 13 on the joints 12; then, two screws 34 are used to penetrate the joint holes 31 on the two handles 30 and the joint holes 13 on the joints 12; then, the nuts 35 are screwed onto the screws 34; the screws 34 serves as the joining components to join the two handles 30 onto the joints 12 on the upper part of the main stand 10.

The weight discs 40 are round discs made of iron or equivalent material; in said weight disc 40 is an accommodating hole 41; the inner diameter of said accommodating hole 41 is slightly larger than the outer diameter of the main stand 10; so that they can be fitted to the outer diameter of the main stand 10; on one side of the accommodating hole 41 is an opening 42; the width of said opening 42 is slightly larger than the outer diameter of the smaller diameter section 11 on the main stand 10, but smaller than the outer diameter of the main stand 10. The smaller diameter section 11 of the main stand 10 may be inserted into the accommodating hole 41 through the opening 42, then, the accommodating hole 41 may slide down along the outer diameter of the main stand 10, and fall onto the base plate 20; so the base plate 20 may support an appropriate number of the weight discs 40; the number of said weight discs 40 depends on the requirement of the user; after the weight discs 40 are positioned onto the base plate 20, since the width of the opening 42 is smaller than the outer diameter of the main stand 10, it will not fall out of the main stand 10; so designed to effectively avoid the weight discs 40 from running out and hurt the user.

Figure 4:
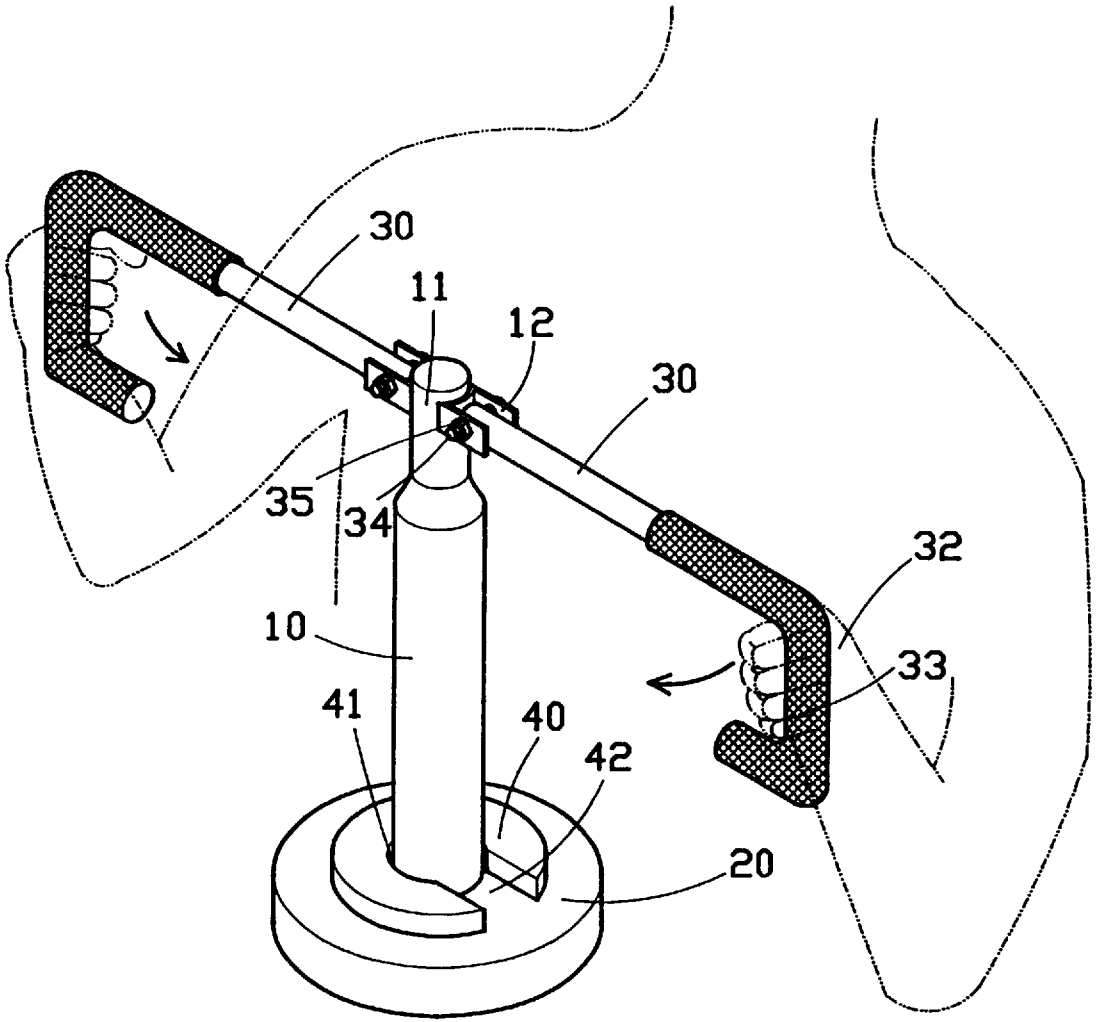
FIG. 4 is an illustration of the subject invention in application.
Figure 5:
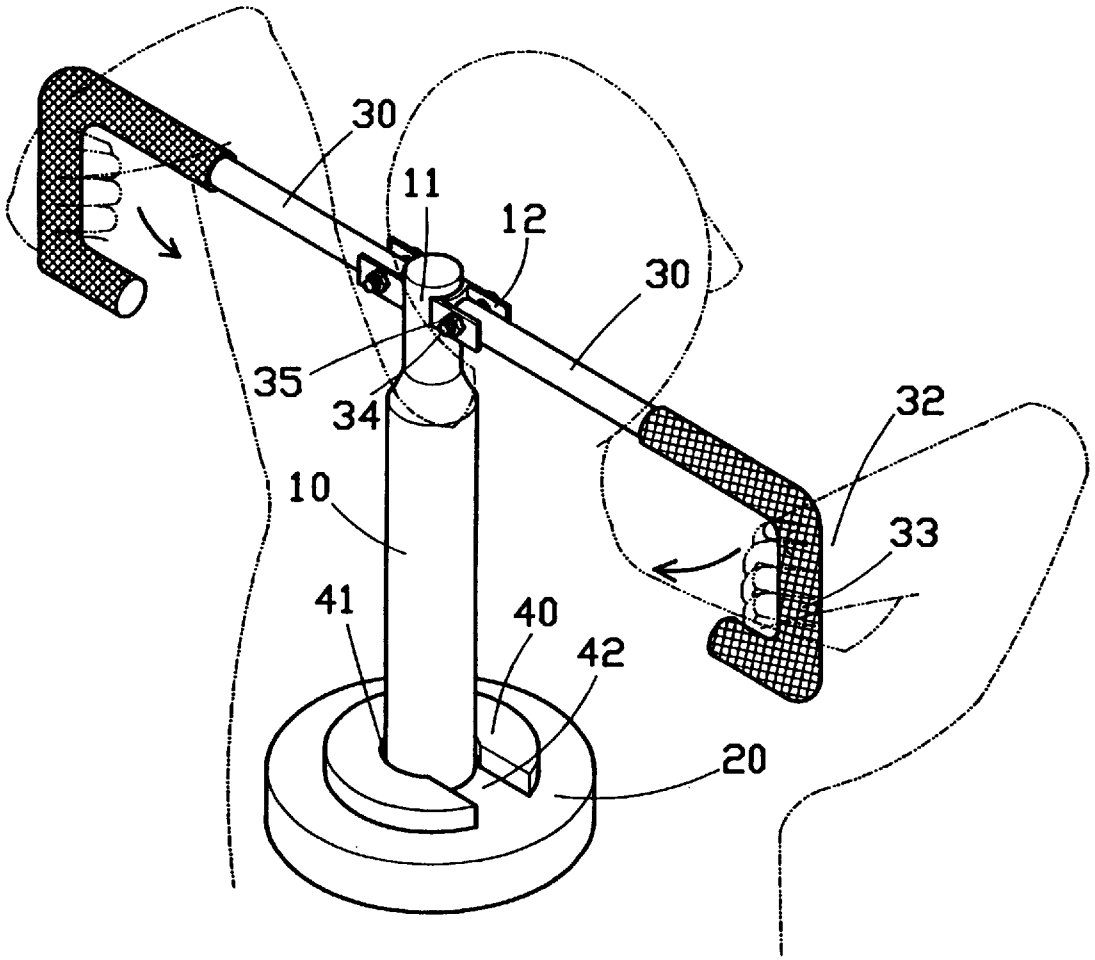
FIG. 5 is an illustration of the subject invention in application.

Please refer to FIGS. 4 and 5 which are the illustrations of the subject invention in application; said arm muscle exerciser may be placed in front of (as shown in FIG. 4) or in the back of (as shown in FIG. 5) of the user; both hands of the user hold onto the handle grips 32 of the two handles 30, and try to lift the main stand 10 which is joined to the inside ends of the two handles 30; by repeated operation of lifting and lowering said main stand 10, and by means of the total weight of the weight discs 40 on the base plate 20, the user's arm muscle may be exercised; it may be used to exercise the muscles on the user's arms, chest, back or other parts of his body; the construction of the subject invention of muscle exerciser is quite simple, its assembling process is easy enough, its production cost very low, its operations quite convenient, and with its unique operational method, as well as the control of the number of weight discs 40 to adjust the total weight for training purposes, an optimum training efficiency may be achieved thereby.

Summing up, the subject invention, with effective improvement on such weaknesses of a prior art of arm muscle exerciser as sophisticated construction, expensive production costs, inconvenient operational procedures, unsatisfactory training efficiency, etc., is an unprecedented new version with its inventive step and originality that will fully meet the qualifications of a patent right, hence this application is filed in accordance with the Patent Law to protect the subject inventor's rights and interests. Your favorable consideration shall be appreciated.

It is declared hereby that the above description, covering only the preferred embodiment of the subject invention, should not be based to limit or restrict the subject claim, and that all equivalent structural and/or configurational variations and/or modifications easily conceivable to anyone skilled in the subject art, and deriving from the subject description with drawings herein shall reasonably be included in the intent of the subject claim.

I claim:

1. An arm muscle exerciser, comprising:

a main stand having a top end and a bottom end, said main stand including a smaller diameter section extending a predetermined length thereof at said top end of said main stand, a base plate, said bottom end of said main stand being secured to said base plate, at least one weigh disk removably positioned over said base plate;

a pair of spaced substantially parallel pivot axles respectively positioned symmetrically on opposing sides of said smaller diameter section of said main stand; and, a pair of handles, each of said pair of said handles pivoting about a respective one of said pair of said pivot axles symmetrically.

2. The arm muscle exerciser, as recited in claim 1, further comprising a pair of U-shaped joints, each said U-shaped joint being secured at a respective one of said opposite sides of said smaller diameter section, and a pair of screws;

each said U-shaped joint including a pair of spaced apart substantially parallel sides, each of said pair of substantially parallel sides having a first joint hole formed therethrough, said first joint holes of each said U-shaped joint being in aligned relationship, each of said pair of said screws passing through a pair of said aligned first joint holes of a respective one of said U-shaped joints, said screws coinciding with said pivot axles.

3. The arm muscle exerciser, as recited in claim 2, wherein each of said handles has a proximal end, a pair of second joint holes being formed at said proximal end, each of said pair of said screws passing through said second joint holes, thereby coupling each of said handles to said smaller diameter section, said proximal end of each of said handles being secured between said sides of a respective one of said U-shaped joints.

* * * * *